US010151138B2

(12) United States Patent
Bourly

(10) Patent No.: US 10,151,138 B2
(45) Date of Patent: Dec. 11, 2018

(54) WINDOW FRAME AND/OR OPENING FRAME

(71) Applicant: Jean Bourly, Reims (FR)

(72) Inventor: Jean Bourly, Reims (FR)

( * ) Notice: Subject to any disclaimer, the term of this patent is extended or adjusted under 35 U.S.C. 154(b) by 0 days.

(21) Appl. No.: 15/171,222

(22) Filed: Jun. 2, 2016

(65) Prior Publication Data

US 2016/0356077 A1 Dec. 8, 2016

(30) Foreign Application Priority Data

Jun. 4, 2015 (FR) ..... 15 55096

(51) Int. Cl.
*E06B 3/36* (2006.01)
*E06B 3/964* (2006.01)
(Continued)

(52) U.S. Cl.
CPC ..... *E06B 3/982* (2013.01); *E06B 3/26* (2013.01); *E06B 3/362* (2013.01); *E06B 3/9641* (2013.01); *E06B 3/9646* (2013.01); *E06B 3/9688* (2013.01); *E06B 2003/2625* (2013.01); *E06B 2003/2639* (2013.01); *E06B 2003/26352* (2013.01); *E06B 2003/26359* (2013.01);
(Continued)

(58) Field of Classification Search
CPC ..... E06B 3/26; E06B 3/362; E06B 3/9641; E06B 3/9646; E06B 2003/2625; E06B 3/9688; E06B 3/982
See application file for complete search history.

(56) References Cited

U.S. PATENT DOCUMENTS 1,335,554 A * 3/1920 Callahan ..... E06B 3/9845 403/231
2,701,040 A * 2/1955 Wick, Sr. ..... E06B 3/9685 160/90
(Continued)

FOREIGN PATENT DOCUMENTS

BE 892856 A * 8/1982
DE 1832198 5/1961
(Continued)

*Primary Examiner* — Charles A Fox
*Assistant Examiner* — Charissa Ahmad
(74) *Attorney, Agent, or Firm* — Young & Thompson

(57) ABSTRACT

Disclosed is a fixed frame or opening frame, resulting from an assembly of joinery profiles, forming the mullions and the cross-members of the frame, with the profiles of the mullions and the cross-member profiles being assembled by their ends. The frame includes at least one device for compressing, including at least one mechanical connection extending interiorly along an intermediary portion of the frame, the at least one mechanical connection connecting by its ends of supports of the device for compressing, the supports being integral respectively with mullions or cross-members, on either side of the intermediate portion of the frame, the mechanical connection being solicited in traction in order to provide the maintaining under constraint of the ends of the joinery profiles of the intermediate portion of the frame against the corresponding ends of the joinery profiles, arranged on either side of the intermediate portion, belonging to the mullions or cross-members.

7 Claims, 10 Drawing Sheets

(51) Int. Cl.

| | |
|---|---|
| ***E06B 3/98*** | (2006.01) |
| ***E06B 3/968*** | (2006.01) |
| ***E06B 3/26*** | (2006.01) |
| *E06B 3/263* | (2006.01) |

(52) U.S. Cl.
CPC ..... *E06B 2003/26361* (2013.01); *E06B 2003/26363* (2013.01); *E06B 2003/26387* (2013.01)

(56) References Cited

U.S. PATENT DOCUMENTS 3,885,371 A * 5/1975 Oakes ..... E06B 3/2675 52/204.595
3,899,258 A * 8/1975 Matthews ..... E06B 1/32 403/292
4,024,690 A * 5/1977 Collins ..... E06B 3/26347 49/449
5,010,708 A * 4/1991 Evans ..... E04B 2/761 403/295
8,322,090 B2 * 12/2012 Moriya ..... E06B 7/10 52/204.591
9,091,119 B2 * 7/2015 Kim ..... E06B 3/9636
9,567,795 B2 * 2/2017 Ou ..... A47G 1/06
2005/0034387 A1 * 2/2005 Bourly ..... E06B 3/14 52/204.5
2007/0053766 A1 * 3/2007 Lin ..... E06B 3/9636 411/389
2007/0107331 A1 * 5/2007 Langner ..... E06B 3/44 52/204.6
2012/0279166 A1 * 11/2012 Valler ..... E06B 3/16 52/656.2
2014/0331576 A1 * 11/2014 Brown ..... E06B 3/26341 52/204.5
2015/0121788 A1 * 5/2015 Kim ..... E06B 3/22 52/309.1
2015/0292259 A1 * 10/2015 Riley ..... E06B 3/9645 52/291

FOREIGN PATENT DOCUMENTS

| | | | |
|---|---|---|---|
| DE | 2329573 | A * | 5/1974 |
| EP | 49694 | A * | 4/1982 |
| EP | 890700 | A2 * | 1/1999 |
| EP | 1251233 | | 10/2002 |
| EP | 1333145 | A2 * | 8/2003 |
| EP | 2284347 | | 2/2011 |
| EP | 2868856 | A2 * | 5/2015 |
| FR | 2118822 | | 7/1972 |
| GB | 2118668 | | 11/1983 |
| JP | 2001065249 | A * | 3/2001 |

* cited by examiner

WINDOW FRAME AND/OR OPENING FRAME

FIELD OF THE INVENTION

The invention relates to a fixed frame and/or opening frame, as well as a unit such as a window, glass door or similar having a fixed frame and at least one opening frame, with the opening frame and/or the fixed frame comprising a frame in accordance with the invention.

BACKGROUND OF THE INVENTION

The field of the invention is that of metal joinery, and more particularly high-end metal joinery, in particular made of bronze. Those skilled in the art know in this field frames conventionally constituted of joinery profiles with a closed section, forming the mullions and the cross-members of the frame, and assembled to one another, edge-to-edge, by their ends. To this effect, a weld bead is carried out on their junction zone on their visible face. For aesthetic reasons, as well as reasons for proper operation, this bead must be partially eliminated, which affects the resistance of the weld, and more generally the overall resistance of the frame, and even its insulating power.

Those skilled in the art further know from document EP1.251.233 A1, an arrangement of metal joinery profiles for the carrying out of an opening frame or fixed frame. For each mullion or cross-member of the frame, the joinery profile is with half-open section, having two wings comprising two longitudinal edges and a core connecting the two wings. The wings and the core of the profile define an internal volume of the half-open profile. The wings of the profile further have stops for a leaf or trim, bearing on the stops, closing the internal volume of the half-open profile. According to this anteriority, the profiles of the arrangement are assembled edge-to-edge by their bevelled ends, thanks to a weld, connecting the profiles on their junction zone. This weld is internal to the internal volume of the profile, and no longer external. Not hindering the aesthetics, or the operation of the window, the weld is entirely retained and the bond constituted as such makes it possible to obtain a window frame or window holder with increased mechanical resistance with respect to the prior art with closed-section profiles, and with partially removed external weld.

According to the observations of the inventor, there is a need for windows or glass doors of large dimensions, which would require, for reasons of mechanical resistance to over-size the metal joinery profiles of the joinery frames such as known in prior art, and in the objective of increasing the resistance of these opening and window frames. Such over-sized frames are not only difficult to produce and expensive, but also not very aesthetic.

SUMMARY OF THE INVENTION

The objective of this invention is to overcome the aforementioned disadvantage by proposing a joinery frame of which the structure allows in particular for the production of a frame of large size, advantageously without requiring over-sizing of the mullions and the cross-members of the frame.

Another purpose of this invention is to propose such a frame that, at least according to one embodiment, does not require a bonding weld, on the junction zones between the mullion profiles and the cross-member profiles, or which at the very least reduces the use of them.

Another purpose of this invention is to propose such a frame that offers good performance in terms of thermal insulation.

Another purpose of this invention is to propose such a frame that offers a careful aesthetic aspect.

Other purposes and advantages of the invention shall appear in the following description which is given solely for the purposes of information and which does not have for purpose to limit it.

Also the invention relates to an opening frame or fixed frame, resulting from an assembly of joinery profiles, forming the mullions and the cross-members of said frame, with the profiles of the mullions and the cross-member profiles being assembled by their ends.

According to the invention, the frame has at least one device for compressing, comprising at least one mechanical connection extending interiorly along an intermediary portion of said frame, constituted by one of the cross-members according to a first alternative, or one of the mullions according to a second alternative, said at least one mechanical connection connecting by its ends of supports of said device for compressing, said supports being integral respectively with said mullions, according to said first alternative, or with cross-members according to the second alternative, on either side of said intermediate portion of the frame, said mechanical connection being solicited in traction in order to provide the maintaining under constraint of the ends of the joinery profiles of said intermediate portion of the frame against the corresponding ends of the joinery profiles, arranged on either side of said intermediate portion, belonging to said mullions, according to said first alternative, or to said cross-members according to the second alternative.

The invention can also have the optional characteristics taken individually or in combination:

- the frame comprises one or several brackets arranged respectively on one or several junction zones between the mullions and the cross-members, at the angles of the frame, said bracket or said brackets, with each one having a first branch and a second branch extending along an angle with respect to the first branch, said first branch extending along one of the mullions, with the second branch extending along one of the cross-members, and wherein said supports of said at least one device for compressing include one, or several of said brackets arranged respectively on the junction zones of two consecutive angles of said frame, with the mechanical connection bearing on one of the brackets, on one of its ends, or joining the two successive brackets by their two ends;
- said at least one mechanical connection is a rod comprising at least one threaded end intended to cooperate by screwing with a tapped portion of said support, in particular with one of the brackets, or to cooperate by screwing with a nut bearing against said support, in order to solicit said at least one mechanical connection in traction;
- each mullion and/or each cross-member of the frame comprises external joinery profiles and at least one internal assembly profile, spacing the external profiles, with said external profiles and said internal profiles having assembly portions, of complementary shape, mutually engaging, in order to ensure the assembly between the internal and external profile(s);
- the assembly portions, of complementary shape, between the external profile and the internal profile cooperate mutually in order to provide the assembly of said profiles when the internal profile is inserted along the external profile;

said internal profiles are plastic, for example made of polyamide and the external profiles are made of metal for example from bronze or is an alloy mainly with a bronze base.

the or each internal profile, has, in a section, a core, in particular tubular, as well as two male portions, protruding laterally on either side of said core, which can be inserted into two complementary cavities formed respectively by the external profiles, with said external profiles forming the two lateral flanks of the mullion M or of the cross-member T, alternately the or each internal profile has a core in particular tubular, as well as two female portions, protruding laterally on either side of said core, wherein can be inserted respectively two male wings of the external profiles, with said external profiles forming the two lateral flanks of the mullion or of the cross-member;

the two external profiles constituting one of the cross-members or one of the mullions of the opening respectively have two main wings, extending in parallel, on either side of the internal profile, and according to two opposite directions, with the main wing of one of the external profiles constituting a covering wing with the fixed frame, bearing a seal, with the main wing of the other external profile constituting a glazing bead for the maintaining of the glazing with the other glazing bead being a removable element, arranged on the other side of the glazing;

the or at least one of the internal profiles has at least one longitudinal recess, in particular with a closed section, internal to said internal profile, extending longitudinally to said profile, said at least one mechanical connection extending in said recess along said internal profile.

said mechanical connection or connections are of axe(s) contained in a median plane of said frame;

the frame comprises at least one pair of mechanical connections solicited in traction in order to provide the maintaining under constraint of the ends of the profile or of the profiles of said intermediate portion of the frame against the corresponding ends of the joinery profiles arranged, on either side of said intermediate portion, belonging to said mullions, according to said first alternative, or to said cross-members according to the second alternative, said two mechanical connections of the pair being parallel between them, arranged symmetrically with respect to a median plane of said frame;

said frame is an opening frame supporting a glazing, simple or multiple;

said glazing is centred on said median plane of said frame of the opening;

the frame comprises two devices for compressing of the frame, with a first device for compressing comprising said at least one mechanical connection extending in an intermediary portion constituted by one of the cross-members according to the first alternative, or one of the mullions according to the second alternative, and a second device for compressing comprising said at least one mechanical connection extending in an intermediary portion constituted by the other of the cross-members according to the first alternative or the other of the mullions according to said second alternative;

said frame is devoid of a fastening weld on the junction zones (between the mullions and the cross-members of said frame).

The invention also relates to a unit comprising a fixed frame and at least one opening frame articulated to the fixed frame in particular by hinges, said fixed frame and/or said opening frame comprising a frame according to the invention.

BRIEF DESCRIPTION OF THE DRAWINGS

The invention shall be better understood when reading the following description accompanied by drawings among which.

Figure 3:
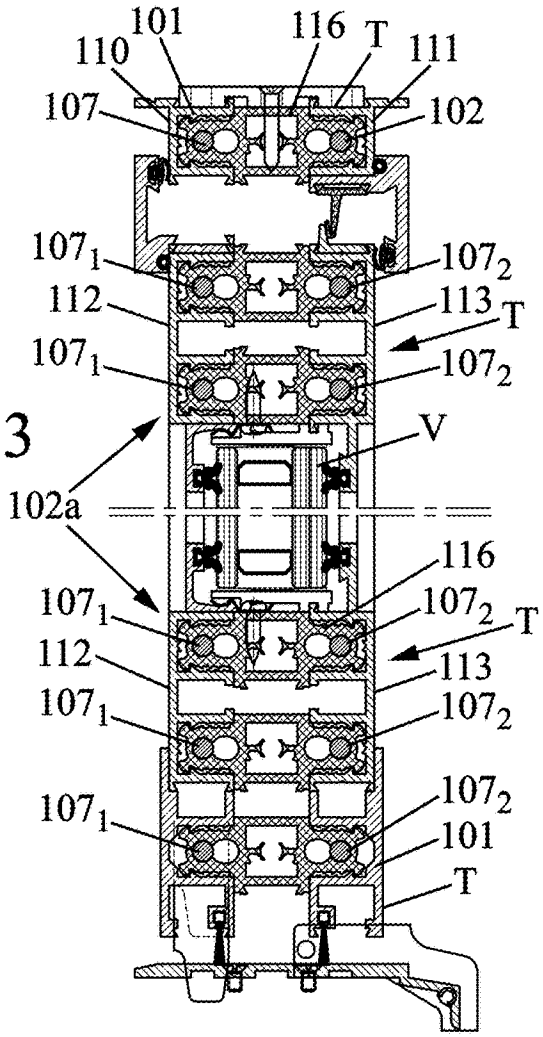
FIG. 3 is a view of the unit according to the vertical cross-section such as shown in FIG. 1.
Figure 1:
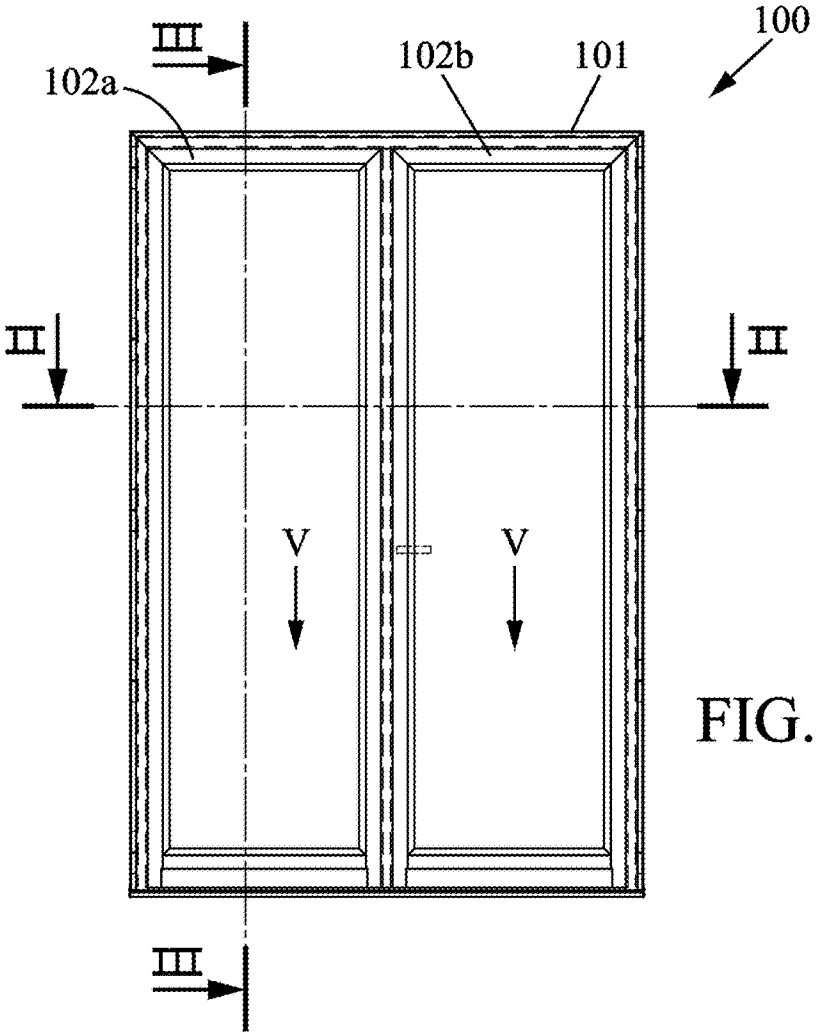
FIG. 1 is a diagrammatical view of a unit according to the invention in accordance with a first embodiment, comprising a fixed frame, and two openings (namely a glass door with a double leaf)
Figure 2:
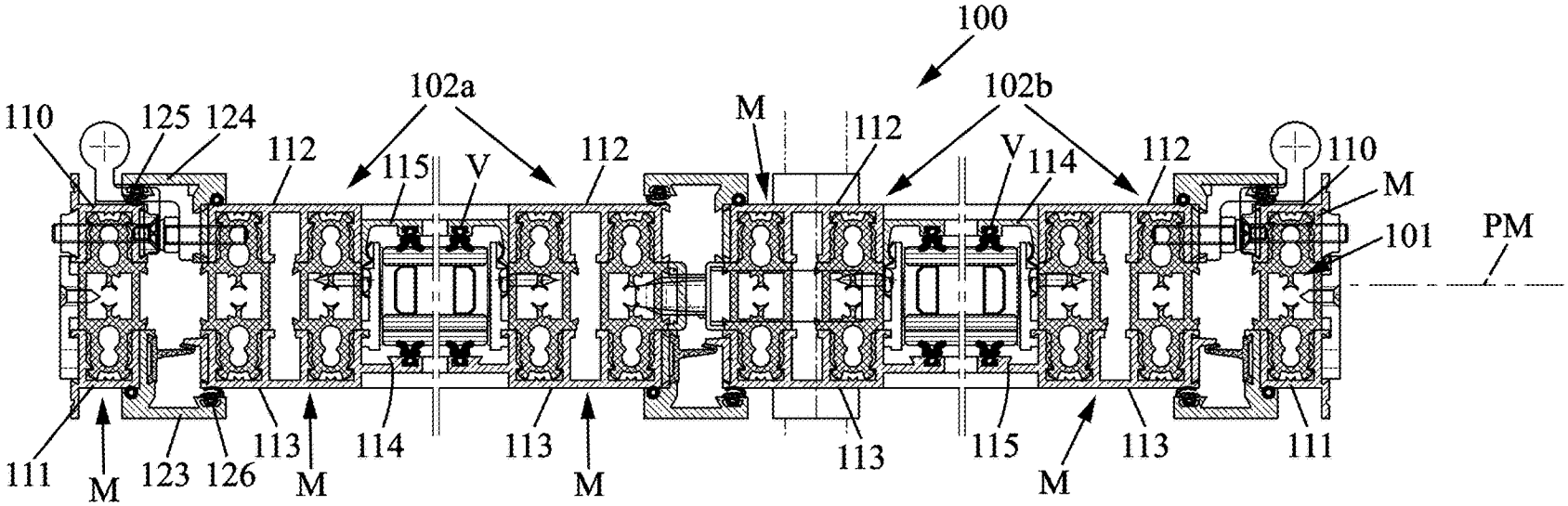
FIG. 2 is a view of the unit according to the horizontal cross-section II-II, such as shown in FIG. 1.
Figure 5:
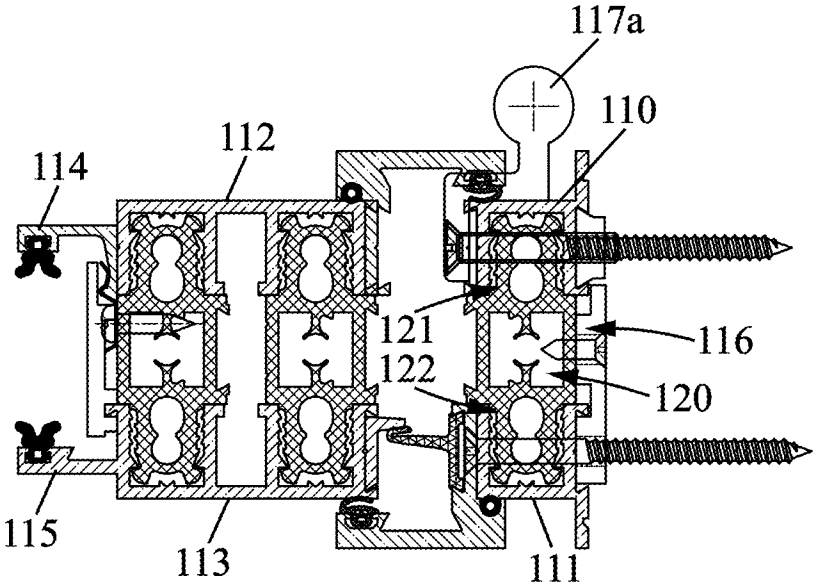
FIG. 5 is a partial view of the unit of FIG. 1 according to a horizontal cross-section on the hinge of the frame.
Figure 4:
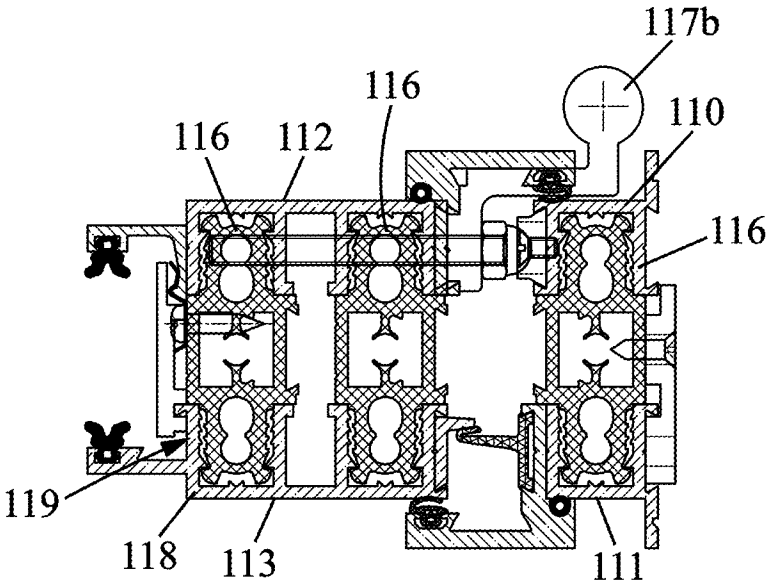
FIG. 4 is a partial view of the unit of FIG. 1 according to a horizontal cross-section on the hinge of the opening.

Also the invention relates to a fixed frame or opening frame 101; 102*a*, 102; 201; 202, resulting from an assembly of joinery profiles, forming the mullions M and the cross-members T of said frame, with the profiles of the mullions and the cross-member profiles being assembled, more preferably edge-to-edge, by their ends.

The frame comprises an internal volume, peripheral, extending along mullions M and cross-members T of the frame, circumscribed by the walls of the external profiles 110, 111; 112, 113; 210, 211; 212, 213 of the mullions M and of the cross-members T of the frame.

According to the invention, the frame advantageously comprises at least one device for compressing 105; 106; 205; 206, comprising at least one mechanical connection 107; 207 extending more preferably interiorly along an intermediary portion of said frame, over its entire length, constituted by one of the cross-members T according to a first alternative, or one of the mullions M according to a second alternative.

Said at least one mechanical connection 107; 207 connects by its ends supports of said device for compressing, said supports bearing respectively on the two mullions M of the frame, according to said first alternative, or on the two cross-members T according to the second alternative.

Said mechanical connection 107; 207 is solicited in traction in order to provide the maintaining under constraint of the ends of the joinery profiles of said intermediate portion of the frame against the corresponding ends of the joinery profiles, arranged on either side of said intermediate portion, belonging to said mullions M, according to said first alternative, or to said cross-members T according to the second alternative.

In other words the elasticity of the section of length of said mechanical connection between the supports is used when solicited in traction in order to compress the intermediate portion, namely the cross-member (resp. mullion), between the ends of the two mullions (resp. cross-member) of the frame.

The use of such a device for compressing makes it possible to increase the rigidity of the frame, in comparison with a frame according to prior art, devoid of such devices for compressing and of which the mullion and cross-member profiles would be fastened to their ends primarily by welds.

Preferably, and in the case of a fixed frame and/or opening frame supporting a glazing V, the glazing V is centred on the median plane of the frame, and the mechanical connection or connections 107; 207 are distributed, either centred on this median plane, or distributed symmetrically with respect to the median plane, and with the purpose of balancing the stresses internal to the frame.

Such a centring of the glazing on the median plane $P_M$ of the frame is all the more so substantial when the assembly between the mullions and the cross-members of the frame is provided without welds, solely by the action of the devices for compressing.

Figure 6:
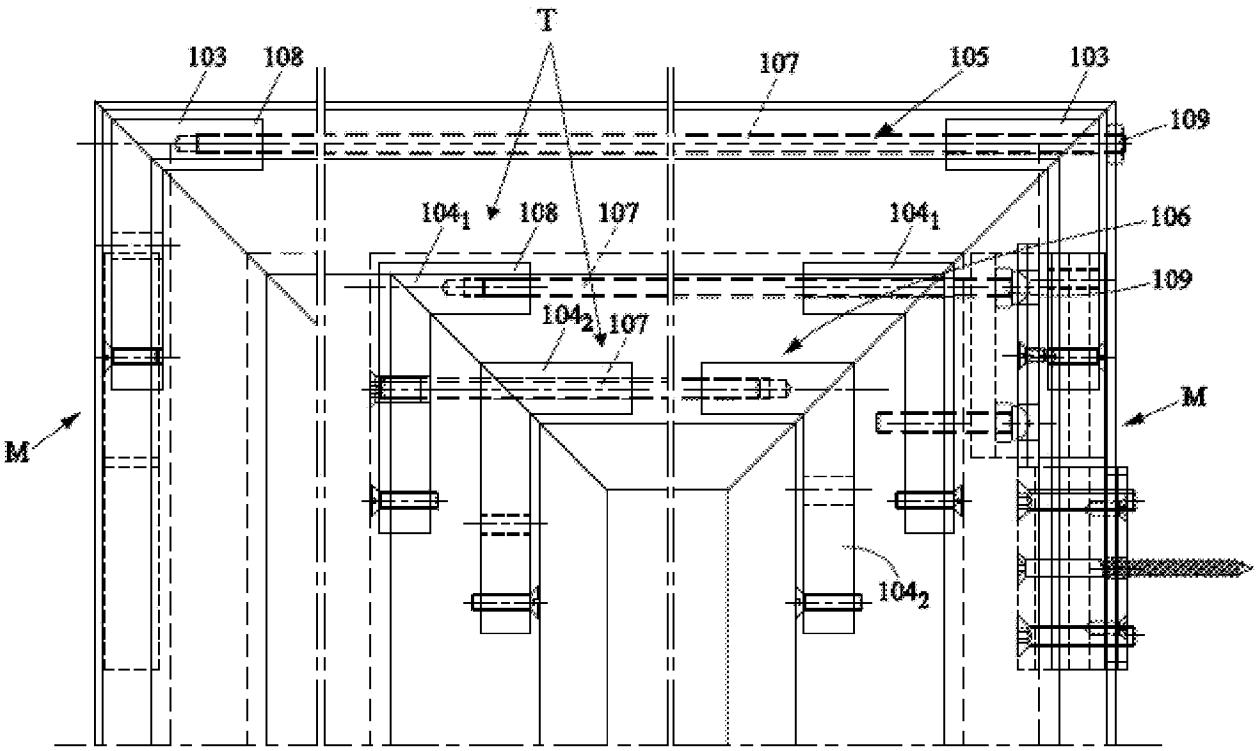
FIG. 6 is a partial view showing transparently the unit according to FIG. 1, and more particularly the assembly of the upper cross-member of the fixed frame (or of the opening frame) to the mullions of the window frame (or of the opening frame), on the bevelled ends of the profiles, thanks to said device for compressing comprising said mechanical connection, in the form of a tie rod, joining supports in the form of brackets.

According to an embodiment, the ends of the mullion M and of the cross-member T, mutually bearing under the action of said device for compressing can be bevelled, in particular by an angle of 45°, in particular with the purpose of forming a right angle between the mullion and the cross-member. As such the end of the profiles of the mullion can be bevelled in particular at 45° and the end of the profiles of the cross-member by a corresponding angle in particular of 45° so as to form a right angle. Such bevelled ends, bearing edge-to-edge, are shown by way of a non-limiting example in FIG. 6 showing the assembly of the upper cross-member T of the frames of the opening (and of the fixed frame), respectively to the upper ends of the mullion of the frames of the opening (and of the fixed frame).

Figure 7:
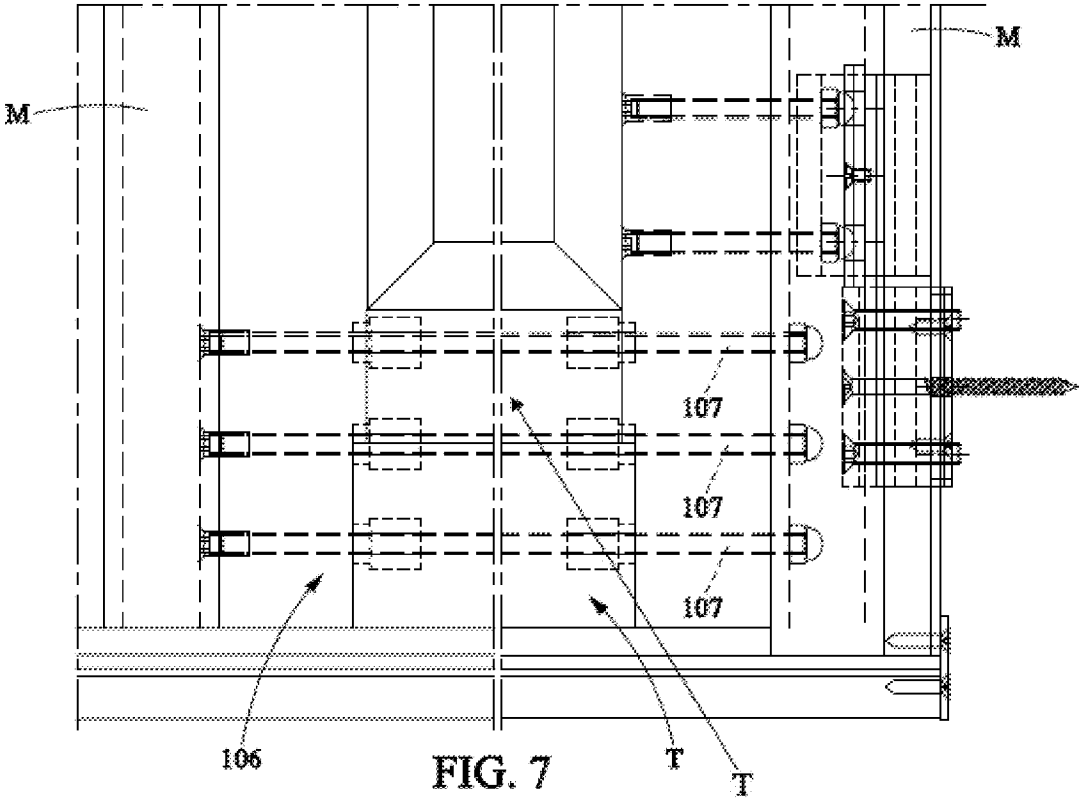
FIG. 7 is a partial view showing transparently the unit according to FIG. 1, and more particularly the assembly of the lower cross-member of the frame of the opening to the mullions of the frame of the opening thanks to said device for compressing comprising said mechanical connection, in the form of a tie rod, and joining supports constituted by the internal profiles of the frame.

The assembly of the ends can be non-bevelled, and as shown by way of a non-limiting example of FIG. 7 showing the assembly of the lower cross-member T of the frame of the opening to the lower ends of the corresponding mullions M. For example and such as shown, the ends of the cross-member are at a right angle with respect to the axis of the mullion, and cooperate laterally with the mullions in particular on an eroded portion of the profiles.

According to an embodiment, said frame can comprise two devices for compressing of the frame, with a first device for compressing comprising said at least one mechanical connection 107; 207 extending more preferably interiorly along an intermediary portion constituted by one of the cross-members T according to a first alternative, or one of the mullions M according to a second alternative, and a second device for compressing comprising said at least one mechanical connection extending more preferably interiorly along an intermediary portion constituted by the other of the cross-members T according to the first alternative, or the other of the mullions according to said second alternative.

As such and according to the first alternative, the frames have devices for compressing of which the mechanical connections 107, 207 extend respectively in the lower and upper cross-members T of the frames. For example and in the embodiments shown, the mechanical connections 107; 207, in particular the tie rods extend in the volume of the cross-members T. It is also possible to provide said mechanical connections within the mullions according to the second alternative not shown in the figures.

According to an embodiment, said at least one mechanical connection 107; 207 can be a rod, in particular a metal rod. This rod can comprise at least one threaded end intended to cooperate by screwing with a tapped portion 108 of said support, or to cooperate by screwing with a nut 109; 208 bearing against said support, directly or indirectly by the intermediary of a washer or other, in order to solicit said at least one mechanical connection 107; 207 in traction. The solicitation of the rod under a traction force, and as such the compressing of the frame is obtained by screwing. The tightening can be carried out by means of a spanner in particular with a determined tightening torque value, or by eye until the ends of the profiles on the junction zones Z are perfectly joined under said effect of compressing. According to an advantageous embodiment, said rod can have two threaded ends, intended to cooperate by screwing with one or two nuts, or with a tapped portion and a tightening nut, two supports arranged on two consecutive angles of said frame. The elasticity of the section of length of the rod between the two supports is then used to pre-stress the frame. Alternatively, and according to another embodiment not shown, said at least one mechanical connection can be a flexible connection, for example a metal cable.

The frame can comprise brackets 103, 104$_1$, 104$_2$, 203, 204, internal to said frame 101; 102; 201; 202 according to a first embodiment shown, or external to the frame according to an embodiment not shown.

These brackets 103, 104$_1$, 104$_2$, 203, 204 are arranged respectively on one or several junction zones Z between the mullions M and the cross-members T of the frame. Said bracket or said brackets 103, 104$_1$, 104$_2$, 203, 204 are assembly elements, internal or external with respect to said frame. The or each one of the brackets has a first branch and a second branch extending along an angle with respect to the first branch, said first branch extending along one of the mullions M, the second branch extending along one of the cross-members T.

Figure 9:
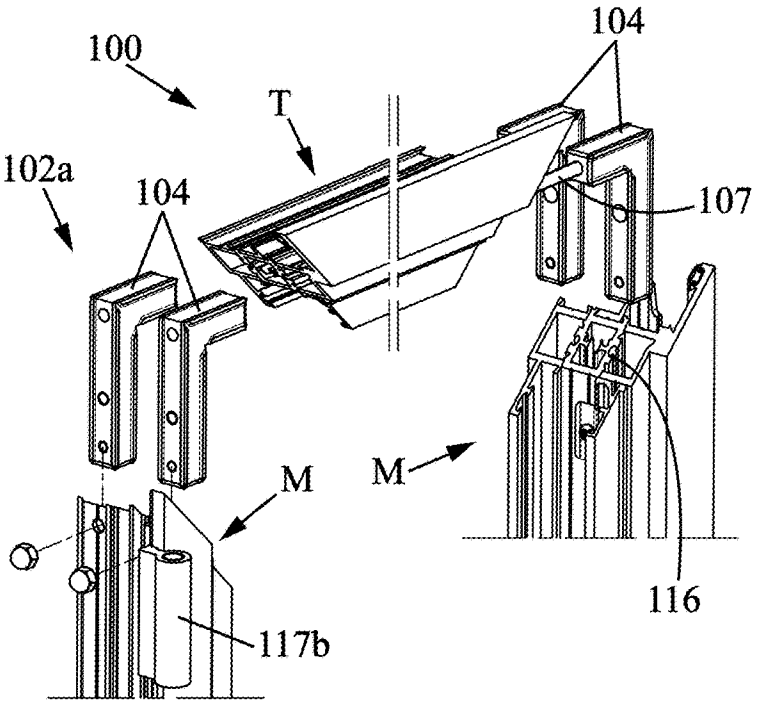
FIG. 9 is a partial view, exploded, of the assembly of the upper cross-member of the opening with the mullions of the opening of a unit in accordance with the invention according to the second embodiment.
Figure 8:
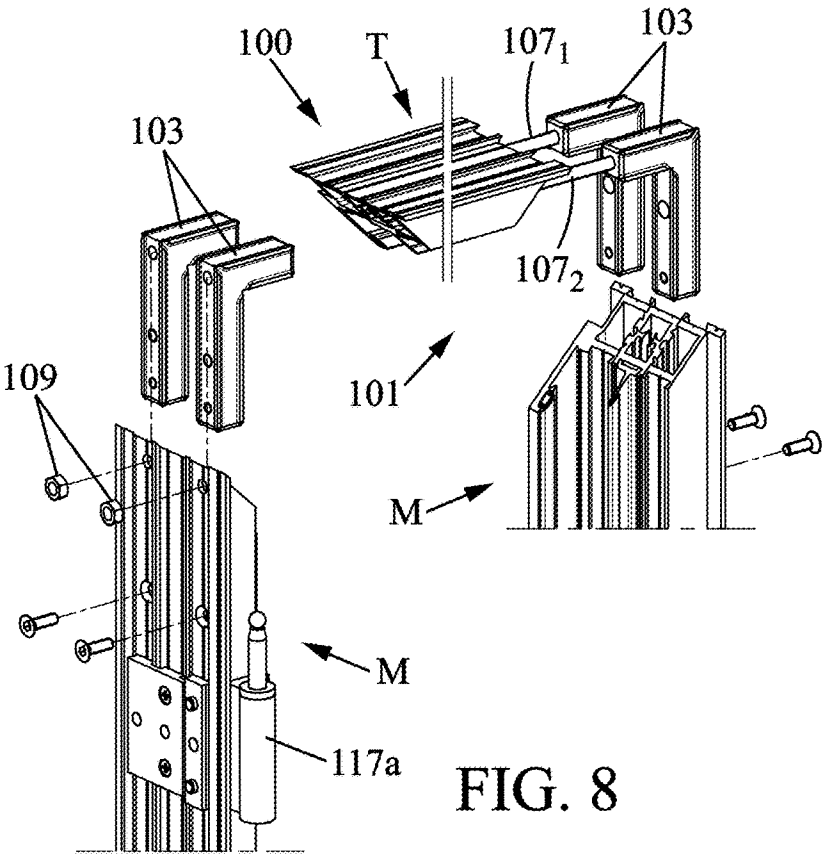
FIG. 8 is a partial view, exploded, of the assembly of the upper cross-member of the frame with the mullions of the fixed frame of a unit in accordance with the invention according to a second embodiment (namely a glass door with a single leaf)

According to the embodiment of FIGS. 8 and 9, and more generally, the first branch of the bracket 103; $\mathbf{104}_1$ or $\mathbf{104}_2$ can be nested in a housing internal to the mullion, and the second branch can be nested in a housing internal to the cross-member with closed section. The branches and the corresponding housing are more preferably of complementary shapes, for example of rectangular section. The mechanical connection 107, in particular the tie rod can extend in the axis of the branches of two brackets. For example in FIG. 6, and for the tie rod extending in the cross-member T, one of the threaded ends of the mechanical connection 107 is screwed into a tapped portion 109 of the branch of the bracket housed in the cross-member. On the other end the tie rod passes through an internal passage of the branch of the other bracket, with the passage being with an axis longitudinal to the branch housed in said cross-member, over the entire length of the branch, from its free end to the right angle of the bracket. The other threaded end of the tie rod exits the bracket in order to cooperate with a nut 109, bearing on a bearing surface of the bracket. As such and more generally, according to this embodiment the tapped portion and/or the internal passage for the mechanical connection are made in the branch of the bracket, the tapped portion or the through-passage are with an axis confounded with the axis of said mechanical connection 107.

According to another alternative shown in FIGS. 14 to 20, the bracket can be bearing on the external surfaces of the lower profiles of the mullion M (or of the cross-member T) of the frame. The first branch bears on the external surface of an internal profile 216 of the mullion, and the second branch on the external surface of an internal profile 216 of the cross-member. The bracket can have a hole, with an axis perpendicular to the axis of the branch, through which the mechanical connection 207 passes. In this embodiment, and more generally, the hole for the passage of the mechanical connection 207 is made in the branch of the bracket, with an axis perpendicular to the axis of the mechanical connection 207. The internal bearing surface of one of the branches can have a protruding lug 209, preferably located on the same branch through which the mechanical connection 207 passes. This protruding lug 209 is intended to cooperate with a complementary hole of an internal profile 216 of the mullion (or of the cross-member) in order to ensure the centring of the bracket and the maintaining of it on the angle of the frame.

According to an embodiment, said supports of said at least one device for compressing comprising one or two so-called brackets, arranged respectively on the junction zones Z of two consecutive angles of said frame 101; 102; 201; 202, said at least one mechanical connection 107, 207 bearing on one of the brackets, on one of its ends, or joining the two successive brackets by their two ends.

According to an embodiment, each mullion M and/or each cross-member T of the frame comprises external joinery profiles 110, 111; 112, 113: 210, 211; 212, 213, and at least one internal profile 116, 117; 216, of assembly. The external profiles 110, 111; 112, 113: 210, 211; 212, 213, can be made of metal in particular from bronze, and where applicable, said internal profiles 116, 117; 216 are plastic for example made of polyamide.

In particular, said external profiles 110, 111; 112, 113: 210, 211; 212, 213 and said internal profiles 116; 216 can have assembly portions, of complementary shape, mutually engaging in order to ensure the assembly between the internal and external profile(s). Generally, the internal profile 116; 216 is inserted between two external profiles 110, 111; 112, 113; 210, 211; 212, 213, intended to respectively form the two lateral flanks of the mullion (or of the cross-member). The internal profile 116; 216 is a spacing element in that it maintains the external profiles by setting the distance that separates them.

The assembly portions, of complementary shape, between the external profile 110, 111; 112, 113: 210, 211; 212, 213 and the internal profile 116 cooperate mutually in order to ensure the assembly when the internal profile 116 is inserted along the external profile 110, 111; 112, 113: 210, 211; 212, 213. Such an assembly of external and internal profiles, by inserting the assembly portions of the profiles along the longitudinal axis of the profiles allows for an assembly, advantageously without elastic deformation of the profiles. This mode of assembly is preferred to a forced embedding which could cause deformations that are detrimental on the joinery profiles. Such a mode of assembly of the joinery profiles by forced embedding is however possible.

For example, and according to an embodiment shown in a non-limiting manner in FIGS. 1 to 9, the or each internal profile 116, has, in a section, a core 120, in particular tubular, in particular rectangular, as well as two male portions 121, 122, protruding laterally on either side of said core.

As such, and according to an embodiment in FIGS. 1 to 9, each internal profile has a core, tubular for example of rectangular section, and two male portions protruding on either side of said core, in particular from two opposite sides of the rectangular section. The internal profile 116, has several longitudinal recesses. The internal profile 116 has as such two longitudinal recesses, in particular symmetrical with respect to a median plane of symmetry of the profile 116, as well as the central recess of the tubular portion of the core of the profile. These longitudinal recesses can allow for the passage of one or several mechanical connections 107 within the internal profile 116. These male portions 121, 122 can be inserted into two complementary cavities formed respectively by the external profiles, said external profiles 110, 111; 112, 113 forming the two lateral flanks of the mullion M or of the cross-member T.

The or each external profile 110, 111, 112, 113 can as such have a main wing, parallel to the median plane of the frame, of which the external surface forms the lateral flank of the mullion, and one or several pairs of secondary wings protruding from the same side of said main wing, opposite the external surface. These secondary wings are perpendicular to the main wing. Each pair of secondary wings defines between the two secondary wings and the main wing an assembly cavity for the male portion of said internal profile 116. As such and for a mullion or a cross-member of the frame of small size according to the direction parallel to the plane of the frame and perpendicular to the direction of the mullion or of the cross-member in question, the mullion or the cross-member can as such include a single internal profile 116, with the internal profile 116 being inserted by its male portions 120, 121 into the external profiles 110, 111. The external profiles 110, 111 then each have a single assembly cavity with a U-shaped section formed between the two wings protruding from the pair and the main wing of the profile 110 or 111. For mullions or cross-members of larger size in this pertinent direction, the mullion M or the cross-member T can comprise two internal profiles 116 or more, parallel and more preferably spaced from one another. As such the two internal profiles 116 are inserted by their male portions 120, 121 respectively into the external profiles 110, 111. The external profiles 110, 111 then each have two assembly cavities (or more), each one with a U-shaped section respectively between the two pairs of wings protruding from the pair and a section of length of the main wing of the profile 112 or 113.

In order to ensure good maintaining, the male portion of the internal profile 116 and the assembly cavities of the external profile can have toothings 118, 119 mutually engaging that opposes the disassembly of these portions. As such the toothing 118 of the cavity can comprise teeth along the wings of the pair and cooperating with a toothing 119 comprising several teeth of the male portion. The toothings 118 and 119, in the form of longitudinal ribs, are designed to allow for an assembly of the profiles 110, 111, 116 or 112, 113, 116 by inserting the assembly portions, according to the axis of the profiles. On the angles of the frame, the male portions of the internal profile 116 can be eroded in order to leave only the portion of the core of the internal profile 116, and with the purpose of leaving two housings, on either side of the portion of the core, with the two housings being defined respectively between the portion of the core and the internal walls of the assembly cavity of the two external profiles. Each housing as such allows for the insertion of a branch of the bracket 103 or 104, such as shown in FIGS. 8 and 9.

The seal between the cross-members and the mullions of the frame can be obtained by covering profiles 123, 124, with covering profiles 123 integral, in particular by welding of the external profiles 111 with the window frame, and covering profiles 124, integral in particular by welding of the external profiles 112 with the frame of the opening. The covering profile 123 of the frame carries a seal 126, intended to cooperate with the flank of the frame of the opening in the closed position of the opening. The other covering profile 14 integral with the window frame carries a seal 125, intended to cooperate with the flank of the window frame in closed position of the opening.

Figure 12:
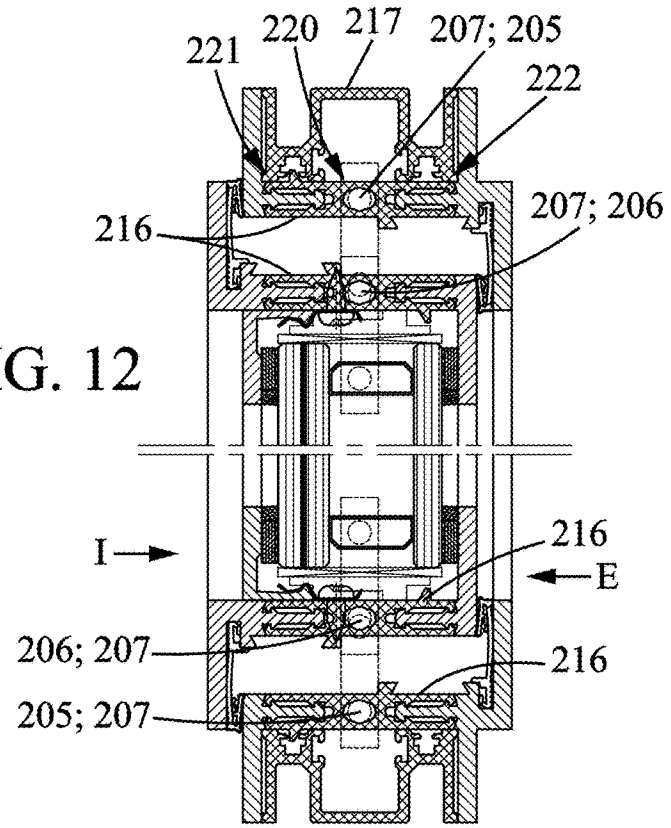
FIG. 12 is a view according to the vertical cross-section XII-XII such as shown in FIG. 10.
Figure 10:
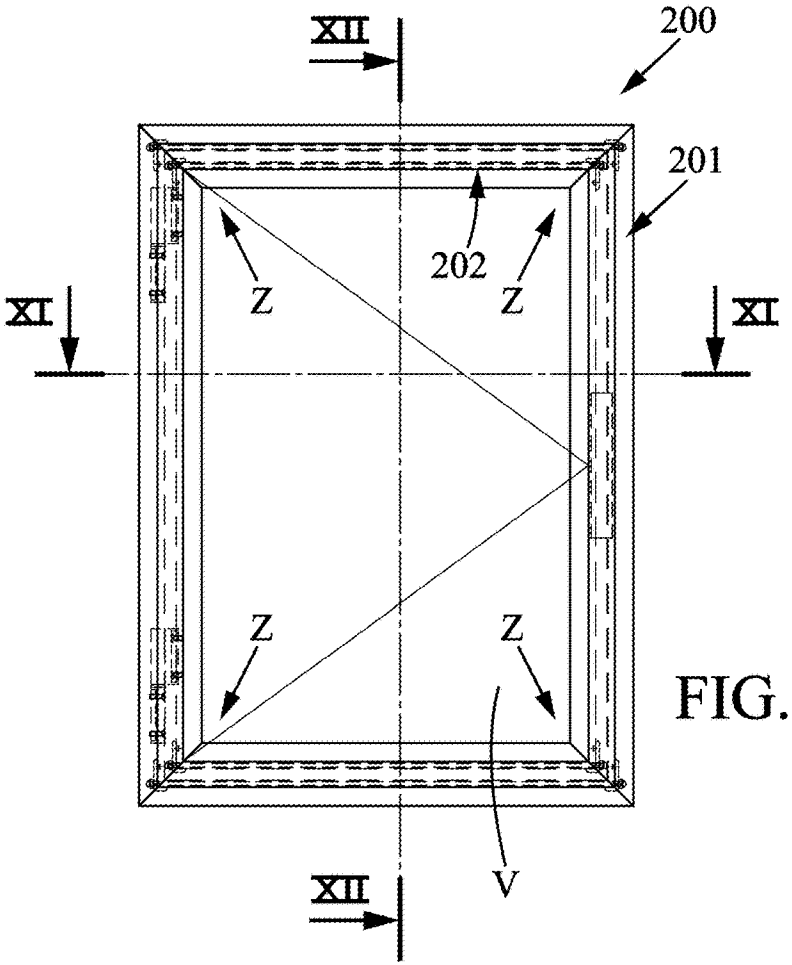
FIG. 10 is a view of a window frame and opening frame unit in accordance with a third embodiment of the invention.
Figure 11:
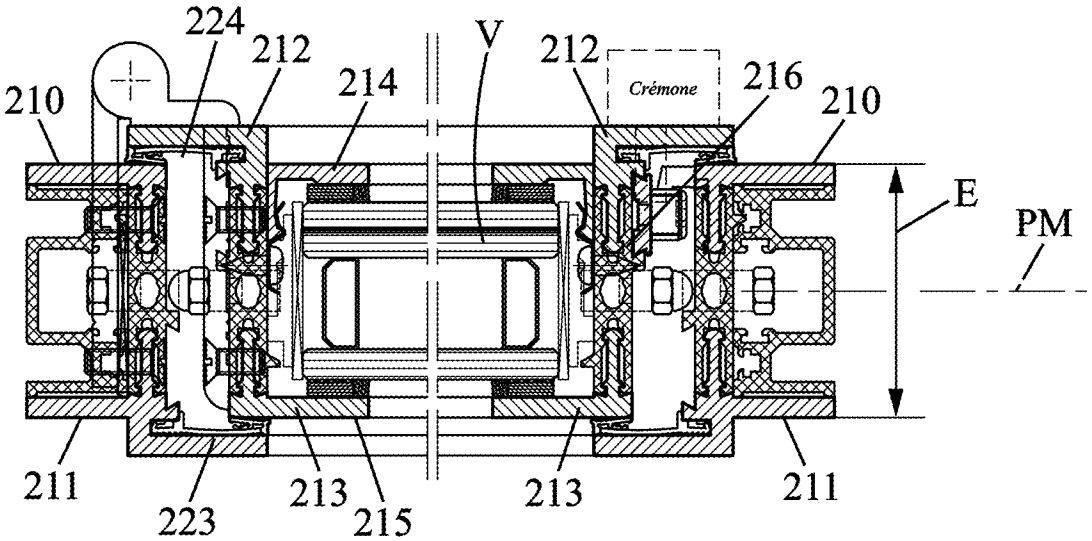
FIG. 11 is a view according to the horizontal cross-section XI-XI such as shown in FIG. 10.
Figure 16:
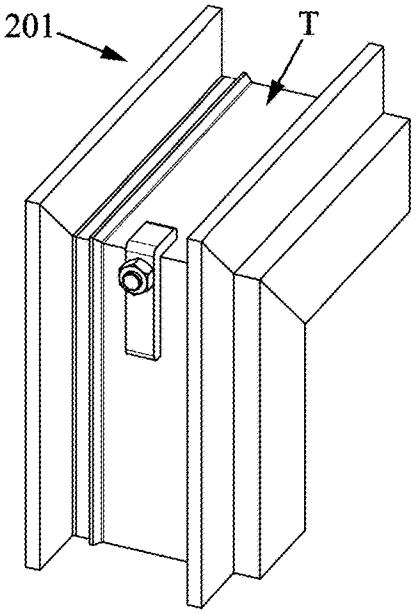
Figure 15:
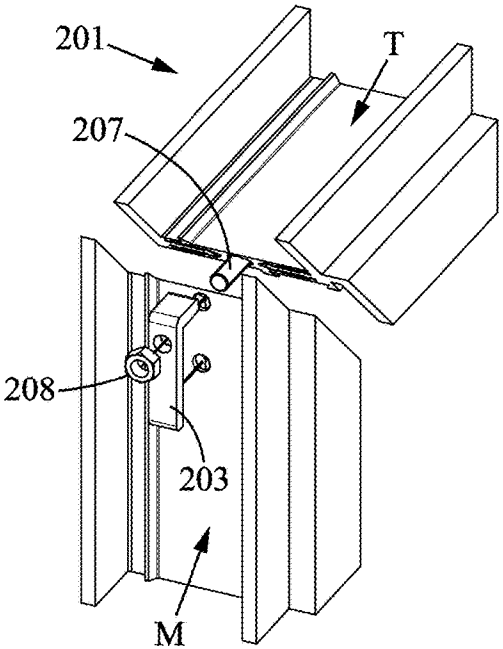
Figure 14:
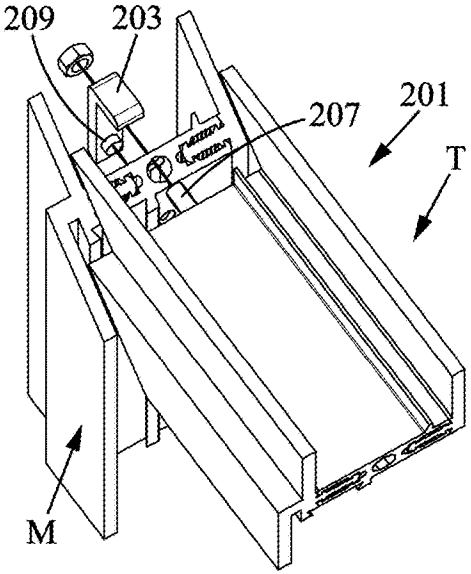
Figure 13:
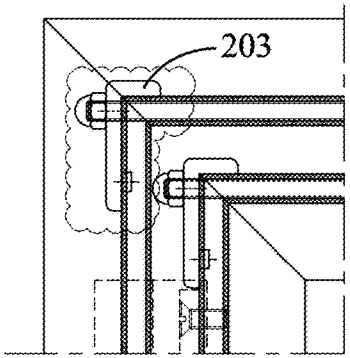
FIG. 13 is a view of the connection zone between the left mullions and the upper cross-members of the frame and of the opening of a unit according to FIG. 10, and FIGS. 14 to 16 are different perspective views of the assembly between the upper cross-member and the mullion of the window frame.
Figure 20:
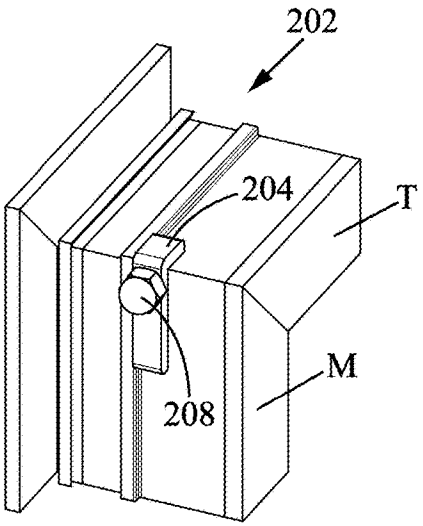
Figure 19:
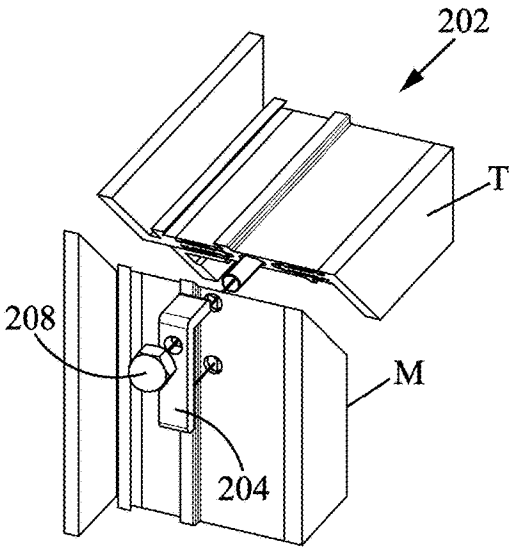
Figure 18:
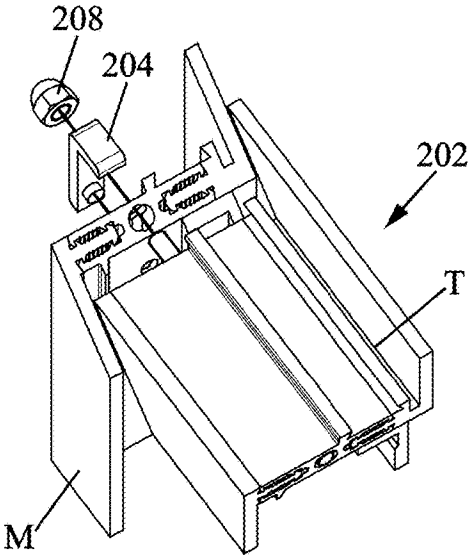
Figure 17:
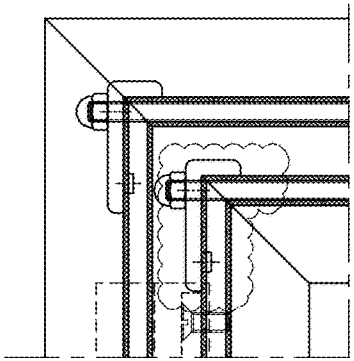
FIG. 17 is a view of the connection zone between the left mullions and the upper cross-members of the frame and of the opening of the unit according to FIG. 13, and FIGS. 18 to 20 are different perspective views of the assembly between the upper cross-member and the mullion of the frame of the opening.

The frame profiles, marked as 113 can again each have a wing of a single piece with said profile 113 extending to the glazing and with a glazing bead function 114. The other glazing bead 115, on the other side of the glazing V is a removable element of the opening frame and in such a way as to allow for the replacing of the glazing. The dimension in thickness of the frame of the opening and of the frame (covering wing excluded), marked as E in FIG. 12, can be less than 60 mm, between 45 mm and 50 mm such as 50 mm.

According to another embodiment, shown in a non-limiting manner of FIGS. 10 to 20 the or each internal profile 216, has a core 220 in particular tubular, as well as two female portions 221, 222, protruding laterally on either side of said core 220, wherein can be inserted respectively two male wings of the external profiles 210; 211; 212; 213. Said external profiles forming the two lateral flanks of the mullion M or of the cross-member T. As such and in FIG. 12, the internal profile 216, with a spacing function, has a core 220, tubular, that authorises the passage of a mechanical connection 207, and on either side of said core 220, two female portions 221, 222, protruding according to two diametrically opposite directions. Each female portion 221, 222 is constituted primarily of two wings parallel between them, forming between them a slot wherein can be received a male wing of the external profile 210, 211, 212, 213, according to the axis of the slot. The male wing of the external profile received in the female portion 221, 222 has lateral ribs, and cooperating with corresponding ribs of the female portion 221, 222, protruding in the slot, starting from said parallel wings of the female portion. The ribs of the male portion and of the female portion cooperate by sliding when the profiles are inserted into one another.

For the fixed frame, the external profiles 210 and 211 constituting the flanks of the cross-members and of the mullions, each one having as such a main wing forming the flank of the mullion or of the cross-member and a male wing, perpendicular, protruding from the assembly portion intended to be inserted into the female portion of the internal profile 216. The main wings of the profiles 210 and 211 forming the two flanks of the mullion or of the cross-member of the frame extend facing each other, in parallel, respectively starting from the two assembly portions of the internal profile 216, on the same side with respect to the internal profile 216, opposite that of the opening. One of the two external profiles of the frame, marked as 211, can still have a covering wing, carrying a seal 223 intended to provide the seal between the fixed frame and the opening frame, with this covering wing extending beyond the internal profile 216, in the direction of the opening. The fixed frames can also comprise an internal profile 217, plastic, in particular intended to partition the volume between the main wings of the profiles 210, 211 forming the two flanks of the cross-members or of the mullions of the frame, with the objective of insulation. This profile 217 also allows for the passage of fastening members, such as screws intended to provide for the fastening of the frame.

For the opening frame, the two external profiles 212 and 213 each constituting cross-members or each mullions of the opening can have two main wings, extending in parallel, respectively from the two assembly portions of the internal profile 216, on either side of the internal profile 116, the main wing of one marked as 212 of the profiles constituting a covering wing with the frame, carrying a seal 224, intended to cooperate with the window frame in the closed position of the opening, the main wing of the profile 213, oriented in the opposite direction with respect to the wing marked as 212, constituting a glazing bead 215 for the maintaining of the glazing. The other glazing bead, 214, located on the other side of the glazing is removable in order to facilitate the replacing of the glazing within the opening frame According to an embodiment, shown in a non-limiting manner of FIGS. 10 to 20, said mechanical connection or connections 207 can be with axes contained in a median plane $P_M$ of said frame 201; 202, and in particular received in the longitudinal recess of the tubular core of the internal profile 216.

As such the compression forces are ensured on the mullions and the cross-members are centred on this plane and so as and as much as possible to solicit the profiles according to the axis. When said frame is an opening frame 102 supporting a glazing V, simple or multiple, advantageously said glazing V can be centred on said median plane Pm of said frame of the opening 102; 202.

According to a second embodiment, shown in a non-limiting manner of FIGS. 1 to 9, said device for compressing 105 or 106 can comprise at least one pair of mechanical connections $\mathbf{107}_1$, $\mathbf{107}_2$. The mechanical connections $\mathbf{107}_1$, $\mathbf{107}_2$ of the pair are solicited in traction in order to provide the maintaining under constraint of the ends of the profile or of the profiles of said intermediate portion of the frame 101; 102*a*; 102*b* against the corresponding ends of the joinery profiles arranged, on either side of said intermediate portion, belonging to said mullions M, according to said first alternative, or to said cross-members T according to the second alternative. Advantageously said two mechanical connections of the pair 107$_1$, 107$_2$ are parallel between them, arranged symmetrically with respect to a median plane $P_M$ of said frame 101; 102. The objective that is still pursued is here to balance the forces in the profiles of the frames, and in such a way centred on the median plane $P_M$.

The supports at the ends of the two connections 107$_1$ 107$_2$ of the pair can be supports, separate and proper, to each mechanical connection.

Generally, the external profiles 110, 111, 112 and 113 (or 210, 211, 212, 213) can be of the shape such as the frame of the opening and/or of the frame having an identical aspect, for the exterior or from the interior, with the glazing being centred on the median plane Pm.

The invention further relates to a unit comprising a fixed frame 101; 201 and at least one opening frame 102*a*, 102*b*; 202 articulated to the fixed frame, said fixed frame and/or said opening frame comprising a frame according to the invention.

The frame of the opening 102*a*, 102*b* 202 can be articulated to the window frame 101, 201 using hinges 117*a*, 117*b* respectively of the frame and of the opening. These can be hinges with an internal mounting for French-style opening (opening of the opening towards the interior of the accommodation) or external hinges for an English-style opening (opening of the opening towards the exterior of the accommodation).

Naturally other embodiments could have been considered by those skilled in the art without however leaving the scope of the invention such as defined by the claims hereinafter.

NOMENCLATURE

M. Frame mullions,
$P_M$. Median plane
T. Frame cross-members,
V. Glazing (opening).

First Embodiment (Embodiment of FIGS. 1 to 7) and Third Embodiment (FIGS. 8 and 9)

100. Unit comprising a fixed frame and an opening frame
101. Fixed frame,
102*a*. Opening frame,
102*b*. Opening frame,
103. Fixed frame brackets,
104, 104$_1$, 104$_2$. Opening frame brackets,
105. Device for compressing (window frame),
106. Device for compressing (opening frame),
107, 107$_1$, 107$_2$. Mechanical connection solicited under traction,
108. Tapped support portion in particular of a bracket,
109. Nuts.
110, 111. External joinery profiles (frame),
112, 113. External joinery profiles (opening),
114, 115. Glazing (opening)
116. Internal assembly profiles,
117*a*, 117*b*. Hinges, respectively of the frame and of the opening
118. Male toothing portion (profile 116),
119. Cavity toothing (external profiles 110, 110, 112, 113),
120. Core (internal profile 116),
121, 122. Male portions (Internal profile 116),
123, 124 Covering profiles,
125, 126. Joints.

Second Embodiment (Embodiment of FIGS. 10 to 20)

200. Unit comprising fixed frame and opening frame
201. Fixed frame,
202. Opening frame,
203. Fixed frame brackets,
204. Opening frame brackets,
205. Device for compressing (window frame 201),
206. Device for compressing (opening frame 202),
207. Mechanical connections solicited under traction,
208. Nuts,
209. Bracket protruding lug,
210, 211. External joinery profiles (frame),
212, 213. Internal joinery profiles (opening),
214, 215. Glazing,
216. Internal assembly profiles,
217. Internal profile,
219. Core (internal profile 216),
220, 221. Female portions (internal profile 216),
223, 224. Seal between frame and opening.

The invention claimed is:

1. A fixed frame or opening frame (101; 102*a*, 102*b*), resulting from an assembly of joinery profiles, forming mullions (M) and cross-members (T) of said frame, ends of the joinery profiles of the mullions being assembled with ends of the joinery profiles of the cross-members, wherein:

each mullion (M), each cross-member (T), or every mullion (M) and cross-member (T) of the frame comprises external joinery profiles (110, 111; 112, 113), and at least one internal assembly profile (116, 117), spacing the external joinery profiles, said external joinery profiles (110, 111; 112, 113) and said at least one internal joinery profile (116) having assembly portions, of complementary shape, mutually engaging, in order to ensure the assembly between said at least one internal joinery profile and said external joinery profiles, said at least one internal joinery profile (116, 117) being plastic and said external joinery profiles (110, 111; 112, 113), being metal, wherein said at least one internal joinery profile (116) has, in a section, a core (120) and two male portions (121, 122) that protrude laterally on either side of said core (120), which can be inserted into two complementary cavities formed respectively by said external joinery profiles (110, 111; 112, 113), said external joinery profiles (110, 111; 112, 113) forming two lateral flanks of the mullion (M) or of the cross-member (T), and wherein at least one of said at least one internal joinery profile (116) has at least two longitudinal recesses, with a closed section, internal to said at least one internal joinery profile (116), extending longitudinally to said at least one internal joinery profile (116), symmetrical with respect to a median plane of symmetry of said at least one internal joinery profile (116), said frame comprising:

a length;

at least one device for compressing (105; 106) comprising at least one pair of mechanical connections (107$_1$, 107$_2$) extending interiorly along an intermediary portion of said frame over all of the length of said frame, said intermediary portion being constituted by one of the cross-members (T) according to a first alternative, or one of the mullions (M) according to a second alternative, said at least one pair of mechanical connections (107$_1$, 107$_2$) extending in said two recesses along said at least one internal joinery profile (116), said at least one pair of mechanical connections having ends connecting supports of said device for compressing, said supports being integral respectively with said mullions (M), according to said first alternative, or with cross-members (T) according to the second alternative, on either side of said intermediate portion of the frame, said at least one pair of mechanical connections (107$_1$, 107$_2$) being solicited in traction in order to maintain under constraint of the ends of the joinery profiles of said intermediate portion of the frame (101; 102*a*; 102*b*) against the corresponding ends of the joinery profiles arranged on either side of said intermediate portion, belonging to said mullions (M), according to said first alternative, or to said cross-members (T) according to the second alternative, each mechanical connection of said at least one pair of mechanical connections (107$_1$, 107$_2$) being parallel to one another, arranged symmetrically with respect to a median plane (Pm) of said frame (101; 102), each mechanical connection of said at least one pair of mechanical connection (107$_1$, 107$_2$) being a rod comprising two ends with at least one of which being a threaded end intended to cooperate either by screwing with a tapped portion (108) of said support or by screwing with a nut (109) bearing against said support, in order to solicit said at least one mechanical connection in traction; and one or several brackets (103, 104$_1$, 104$_2$), (101; 102*a*; 102*b*), arranged respectively on one or several junction zones (Z) between the mullions (M) and the cross-members (T), at angles of the frame, said one or several brackets (103, 104$_1$, 104$_2$, 203, 204), with each having a first branch and a second branch extending along an angle with respect to the first branch, said first branch extending along one of the mullions (M), the second branch extending along one of the cross-members (T), wherein said supports of said at least one device for compressing include one or several of said brackets arranged respectively on the junction zones (Z) of two consecutive angles of said frame (101; 102), with each mechanical connection of said at least one pair of mechanical connection (107$_1$, 107$_2$) bearing on one of the brackets, at one end of said mechanical connection, or joining the two successive brackets by the two ends of said mechanical connection.

2. The frame according to claim 1, wherein the assembly portions, of complementary shape, between the external joinery profile (110, 111; 112, 113: 210, 211; 212, 213) and the internal joinery profile (116) cooperate mutually in order to provide the assembly of said joinery profiles when the internal joinery profile (116) is inserted along the external joinery profile (110, 111; 112, 113: 210, 211; 212, 213).

3. The frame according to claim 1 wherein the metal is bronze or is an alloy mainly with a bronze base.

4. The frame according to claim 1, wherein said frame is an opening frame (102) supporting a glazing (V), simple or multiple.

5. The frame according to claim 4 wherein said glazing (V) is centred on said median plane (Pm) of said opening frame (102).

6. The frame according to claim 1, wherein said frame is devoid of fastening welds on the junction zones (Z) between the mullions (M) and the cross-members (T) of said frame.

7. A unit comprising a fixed frame (101) and at least one opening frame (102*a*, 102*b*) articulated to the frame, at least one of said fixed frame or said at least one opening frame being according to claim 1.

* * * * *